US005572868A

United States Patent [19]

Okamoto et al.

[11] Patent Number: 5,572,868

[45] Date of Patent: Nov. 12, 1996

[54] EXHAUST MANIFOLD

[75] Inventors: Masami Okamoto; Yoshifumi Sogo; Eiji Nawata, all of Toyota; Naofumi Masuda, Nagoya; Wataru Ozawa, Toyota, all of Japan

[73] Assignee: Aisin Takaoka Co., Ltd., Toyota, Japan

[21] Appl. No.: 391,003

[22] Filed: Feb. 21, 1995

[30] Foreign Application Priority Data

Feb. 21, 1994 [JP] Japan ..... 6-061988

[51] Int. Cl.[6] ..... F01N 7/10

[52] U.S. Cl. ..... 60/323; 60/324; 29/890.08; 285/150

[58] Field of Search ..... 60/321, 322, 323, 60/324; 285/150; 29/890.08

[56] References Cited

U.S. PATENT DOCUMENTS

| | | | |
|---|---|---|---|
| 4,373,331 | 2/1983 | Santiago et al. | 60/323 |
| 4,386,586 | 6/1983 | Santiago et al. | 60/323 |
| 4,621,494 | 11/1986 | Fujita | 60/323 |
| 5,014,903 | 5/1991 | Cyb | 60/323 |
| 5,134,852 | 8/1992 | Weeks | 60/323 |
| 5,327,722 | 7/1994 | Clegg et al. | 60/323 |

FOREIGN PATENT DOCUMENTS

| | | | |
|---|---|---|---|
| 1-119824 | 2/1963 | Japan . | |
| 15622 | 1/1984 | Japan | 60/323 |
| 61-82019 | 5/1986 | Japan . | |
| 62-188515 | 12/1987 | Japan . | |
| 63-126515 | 8/1988 | Japan . | |
| 1-69114 | 5/1989 | Japan . | |
| 3-25815 | 7/1991 | Japan . | |
| 5-171932 | 7/1993 | Japan . | |
| 6-31140 | 8/1994 | Japan . | |
| 493619 | 10/1938 | United Kingdom . | |
| 2058918 | 4/1981 | United Kingdom . | |

OTHER PUBLICATIONS

Van Cleave, "The Electron Beam at Work in Detroit," Iron Ave, vol. 221, No. 2, Jan. 9, 1978, p. 26.

*Primary Examiner*—Leonard E. Heyman

*Attorney, Agent, or Firm*—Burns, Doane, Swecker & Mathis, L.L.P.

[57] ABSTRACT

An exhaust manifold in which a plurality of branch tubes at an inlet side are connected to a collecting tube at an outlet side, and in which the fluid flows from the branch tubes to the collecting tube, wherein a volumetric chamber is provided between at least a pair of the branch tubes in communication with the branch tubes, with the volumetric chamber being gradually increased in its cross-sectional area in a fluid flowing direction. An exhaust manifold formed of upper and lower members comprises a branch tube having a bend. The upper lower members are interconnected by joining flanges having a broader width in the vicinity of the bend than other joining flange portions.

14 Claims, 6 Drawing Sheets

CHANGE IN PULSATING PRESSURE (1 cycle/4000 rpm) OF EXHAUST GAS

EXHAUST MANIFOLD

FIELD OF THE INVENTION

This invention relates to an improved exhaust manifold. More particularly, it relates to an exhaust manifold connected to an exhaust conduit of an internal combustion engine of a vehicle.

BACKGROUND

In JP Patent Kokai JP-A-5-171932, there is disclosed a conventional exhaust manifold made up of an upper member and a lower member separated from each other at a plane passing substantially through the center axis of a collecting tube and four branched tubes connected to the collecting tube, with the outer two branch tubes being bent substantially at right angles to the collecting tube. On the outer periphery of the upper member and the lower member are formed joining flanges of the same width. At the connecting portions of the collecting tube and the branch tubes, intermediate between the branch tubes, there is mounted a partition for adjusting the exhaust gas stream and reducing the noise of interference of the exhaust gas streams flowing via the respective branch tubes. The exhaust manifold is assembled by connecting the upper and lower members, each formed from a sole metal plate by pressing or sheeting, by joining flange portions formed at the outer periphery of the upper and lower members, and welding the outer peripheral area in its entirety.

However, by connecting plural branch tubes to the sole collecting tube, there is produced a difference in length of the branch tubes, such that a few of the branch tubes become bent. Above all, in the case of an exhaust manifold for an internal combustion engine for a vehicle, the degree of bending of the branch pipes is further increased because of limitations on the external structure of the exhaust manifold and due to necessity of space saving.

On the other hand, when connecting such exhaust manifold to the exhaust side of the cylinder of an internal combustion engine, the hot exhaust gas flows intermittently into the exhaust manifold, so that the exhaust manifold is subjected to thermal shock or stress due to repeated heating and cooling. Thus the non-linear portion, especially the bent portion of the branch tube, is susceptible to crevices, as a result of which the exhaust manifold is lowered in durability.

In JP UM kokai publication 3-25815, there is proposed an exhaust manifold communicating with the exhaust port of the multi-cylinder engine and having plural branch tubes, in which bellow-shaped thermal deformation absorbing portions are provided at an area of the branch tubes undergoing larger thermal deformation.

However, the provision of such bellows in the branch tubes leads to complex shape and difficulties in machining. Above all, if such exhaust manifold is fabricated by joining an upper half member and a lower half member, difficulties are met in matching the joining surfaces of the upper and lower members with high precision, with the result that machining costs are increased.

In JP Patent Kokai JP-A-5-171932, there is disclosed an exhaust manifold in which a partition wall is provided in the collecting tube with a view to preventing larger interference noises or impact noises from being produced by sudden impact and interference of the effluent exhaust gas flows from the branch tubes, thereby preventing an engine output of the exhaust engine from being lowered.

However, the provision of such partition wall produces the impact of the effluent exhaust gas flows from the branch tubes onto the partition wall or the sudden confluence of the effluent exhaust gas flows from the respective branch tubes at a high pressure at a portion where the partition wall is depleted, thereby still producing the interference noises of the exhaust gas.

SUMMARY OF THE DISCLOSURE

Accordingly, it is an object of the present invention to provide an exhaust manifold for decreasing the interference noise of the exhaust gas.

It is another object of the present invention to improve durability of the exhaust manifold, particularly, to provide an exhaust manifold wherein crevices may be prevented from being formed at a bend portion interconnecting the branch tube and the collecting tube.

It is a further object of the present invention to improve the output efficiency of the internal combustion engine in an exhaust manifold connecting to the exhaust side of the internal combustion engine having plural cylinders.

Still further objects will become apparent in the entire disclosure.

According to a first aspect of the present invention, the present invention provides an exhaust manifold in which a plurality of branch tubes disposed at an inlet side are connected to a collecting tube disposed at an outlet side and in which fluid flows from the branch tubes to the collecting tube, wherein a volumetric chamber is provided between at least a pair of the branch tubes in communication with the pair of branch tubes, with the volumetric chamber being gradually increased in its cross-sectional area as viewed in a plane normal to a general flowing direction of the fluid along the flowing direction.

Thus the fluid flowing into the branch tubes is gradually increased in volume as it flows into and through the volumetric chamber and is lowered in flow rate and fluid pressure before being confluent with other fluid portions flowing out of the remaining branch tubes. This reduces the noise sound of interference between the fluid flows flowing out of the different branch tubes.

According to a second aspect of the present invention there is provided also an exhaust manifold having at least an upper member and a lower member, in which a plurality of branch tubes disposed at an inlet side are connected to a collecting tube disposed at an outlet side. At least one of the branch tubes is a branch tube having a bend. The upper member and the lower member are interconnected by joining flanges of the upper and lower members, in which a joining flange portion in the vicinity of the bend has a broader width than the other joining flange portions.

Thus the stress tending to separate the upper member and the lower member from each other may be absorbed by the joining flange portion having the broader width. That is, if the force acts on the bend of the branch tube in the direction of separating the upper and lower members of the exhaust manifold from each other, the outer portions (outer peripheral portions) of the exhaust manifold at the joining flange portion having the broader width are kept in a state of intimate contact, while the inner areas of the flanges of the exhaust manifold absorb such force and are thereby remaining slightly separated from each other. Thus the stress may be prevented from being propagated to other portions of the exhaust manifold, while the state of intimate contact of the exhaust manifold is maintained as a whole. Additionally, the joining flange portion of the broader width has a high cooling capacity, and heat dissipation from such portion improves durability of the bend of the branch tube which tends to be raised in temperature.

BRIEF DESCRIPTION OF THE DRAWINGS

FIG. 4 shows a cross-section of a joining flange 5*a* in the vicinity of a bend 6 of a branch tube 3*a* to an enlarged scale, where

PREFERRED EMBODIMENTS

Figure 1:
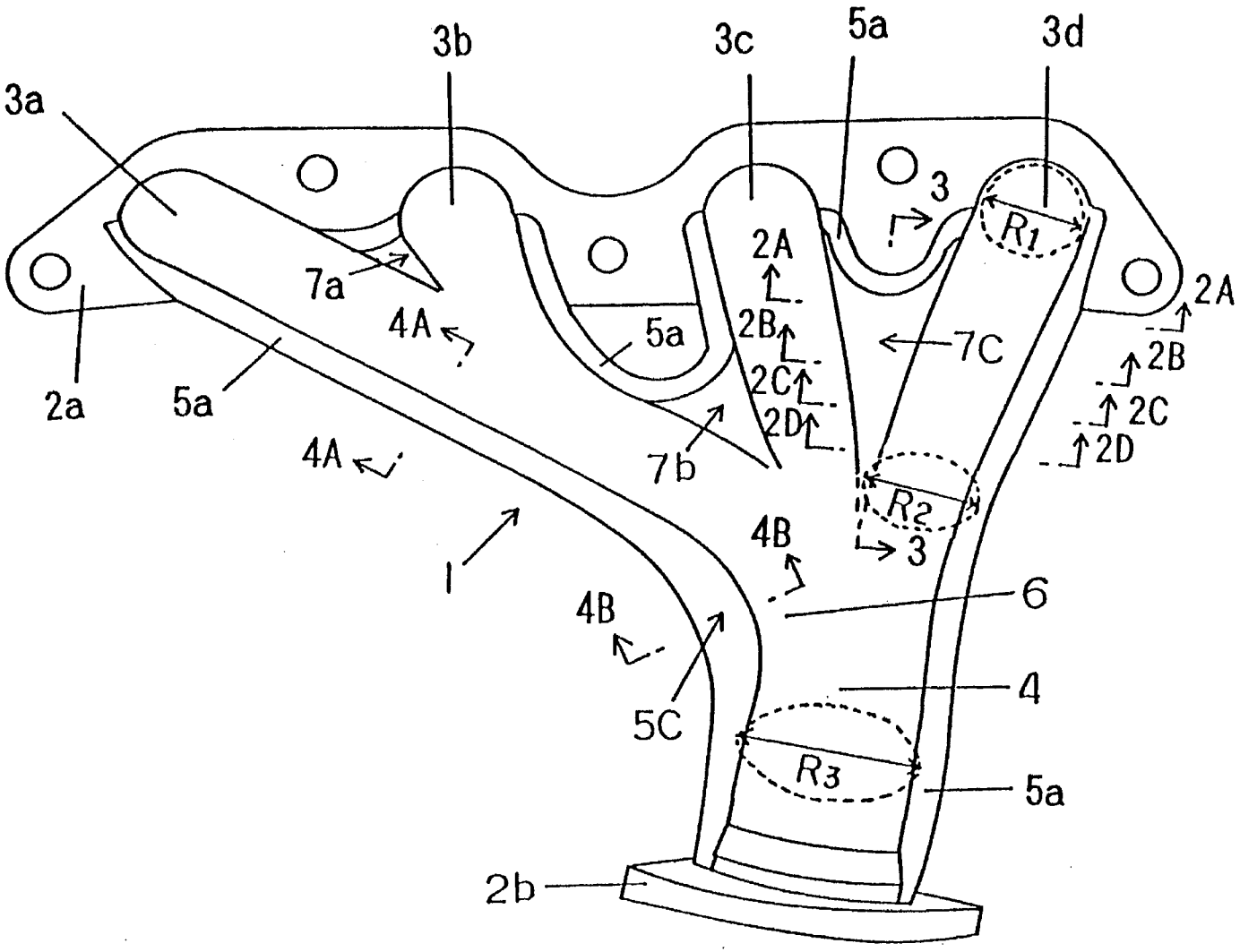
FIG. 1 is a perspective view of an exhaust manifold according to an embodiment of the present invention, as seen from above.

Referring to the drawings, illustrative embodiments of the present invention will be explained in detail, which should not be understood as limitative.

FIG. 1 is a perspective view of an exhaust manifold according to an embodiment of the present invention, as seen from above.

Referring to FIG. 1, the exhaust manifold of the present embodiment includes a main body member of a manifold 1 made up of an upper member 1*a* and a lower member 1*b*, not shown (refer to FIGS. 2A–2D), with a mounting flange 2*a* and a mounting flange 2*b* being mounted at an inlet side and an outlet or exhaust side of the main body member 1.

The upper member 1*a* and the lower member 1*b* are connected to each other at branch tubes 3*a*, 3*b*, 3*c* and 3*d* and the center axis of a collecting tube 4 in a certain plane as a boundary.

The four branch tubes 3*a*, 3*b*, 3*c* and 3*d* disposed at the inlet side of the main member 1 are connected to the collecting tube 4 disposed at the outlet side. The imaginary tube diameter at the connecting portions between the branch tubes and between the branch tubes and the collecting tube is enlarged for convenience in connection.

Along the outer periphery of the main member 1, a joining portion 5*c* is formed on the upper member 1*a*. The joining portion 5*c* is joined with a joining portion 5*b* (not shown) of the lower member 1*b* by welding to form an integral body of the upper and lower members (1*a*, 1*b*).

The joining flange portion 5*c* in the vicinity of the bend portion 6 of the longest branch tube 3*a* designates relevant portions of the connecting flanges 5*a* and 5*b*. The longest branch tube 3*a* among all the branch tubes is bent to the utmost extent at the bend marked by 6 and is there connected to the collecting tube 4.

The joining flange portion 5*c* is broader in width than the remaining flange portions 5*a* and 5*b* (portion at the inlet side of the branch tube 3, portion between the branch tubes 3*b* and 3*c* and portion between the branch tubes 3*c* and 3*d*, and the connecting flange portion along the collecting tube 4 and the branch tube 3*d*, etc.).

Between the branch tubes 3*a* and 3*b*, neighboring to each other, there is formed a volumetric chamber 7*a* defined by the upper and lower members 1*a* and 1*b* and gradually increased in the cross-sectional area from the inlet towards the outlet of the main body member of the manifold 1. This cross-sectional area increases along the direction of the general flowing direction of fluid (gas). The cross-sectional area is defined in a plane normal to the general flowing direction of fluid, typically, a direction of a center line between axes of a pair of neighboring, merging tubes.

Similarly, between the branch tubes 3*b* and 3*c* and between the branch tubes 3*c* and 3*d*, neighboring to each other, there are formed volumetric chambers 7*b* and 7*c* defined by the upper and lower members 1*a* and 1*b* and gradually increased in the cross-sectional area from the inlet towards the outlet of the main body member of the manifold 1.

FIGS. 2A to 2D are cross-sectional views partially enlarged and taken along lines 2A—2A, 2B—2B, 2C—2C and 2D—2D in FIG. 1, from the inlet side to the outlet side of the manifold, showing the cross-section of the volumetric chamber 7*c* between the branch tubes 3*c* and 3*d* extending at right angles to the general flow direction, respectively. FIG. 3 is a cross-sectional view partially enlarged and taken along line 3—3 in FIG. 1, showing a cross-section of the volumetric chamber 7*c* extending parallel to a center line of the volumetric chamber 7*c* directed to a merging point of tubes.

Referring to FIGS. 2 and 3, the structure of the volumetric chamber is explained along the general flow direction (the direction from the inlet towards the outlet) of the exhaust gas stream of the main body member of the manifold 1.

Figure 2A:
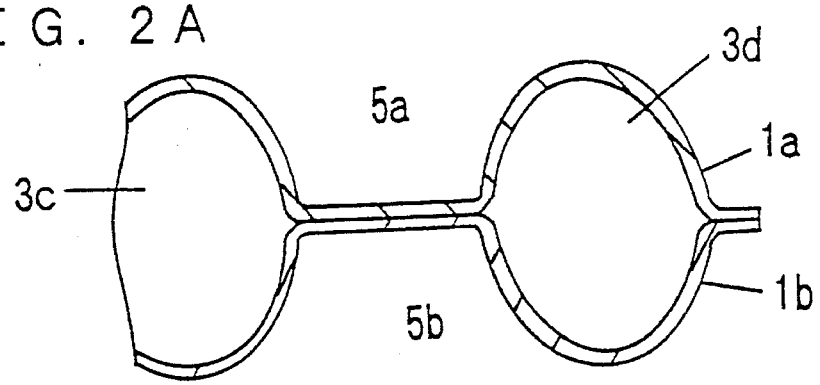
FIGS. 2A to 2D are cross-sectional views, partially enlarged and respectively taken along lines 2A—2A, 2B—2B, 2C—2C and 2D—2D in FIG. 1, in the order from the inlet side to the outlet side of the manifold, showing the cross-section of a volumetric chamber 7*c* between branch tubes 3*c* and 3*d* taken at right angles to the general flow direction.
Figure 3:
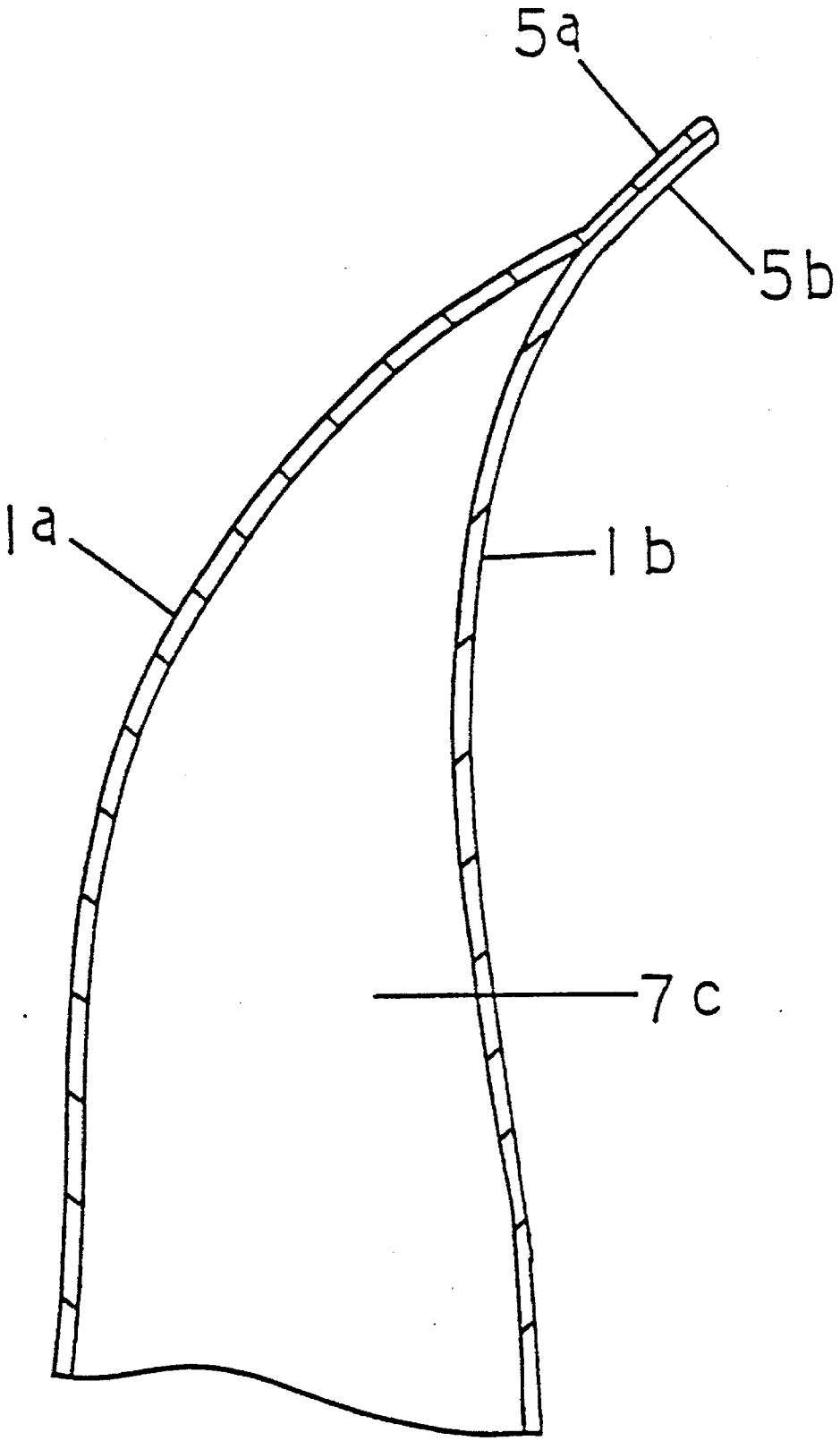
FIG. 3 is a cross-sectional view, partially enlarged and taken along line 3—3 in FIG. 1, showing a cross-section of the volumetric chamber 7*c* extending parallel to the general flow direction.

In the cross-sectional view of FIG. 2A, showing the cross-section of the inlet side of the main body member of the exhaust manifold 1, the upper member 1*a* and the lower member 1*b* define the branch tube 3*c* and the branch tube 3*d*, with the upper member 1*a* and the lower member 1*b* being joined to each other by an upper flange portion 5*a* and a lower flange portion 5*b* between the branch tubes 3*c* and 3*d*.

Figure 2B:
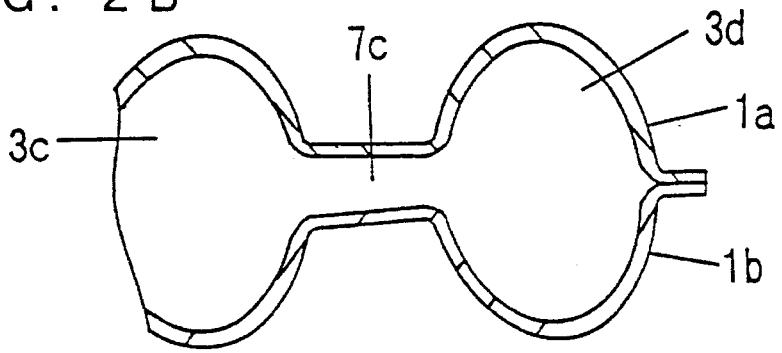

Referring to FIG. 2B, the connecting flange portions 5*a*, 5*b* are spaced apart from each other and the upper member 1*a* and the lower member 1*b* define the volumetric chamber 7*c* communicating with the branch tubes 3*c* and 3*d*.

Figure 2C:
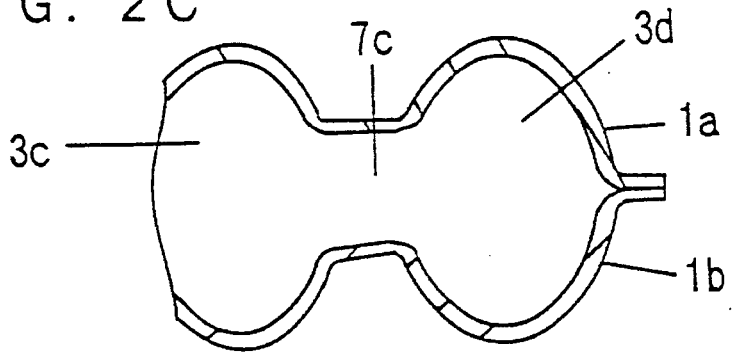
Figure 2D:
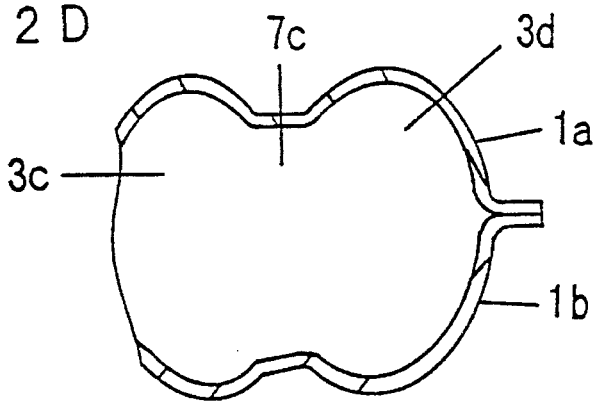

Referring to FIGS. 2C and 2D, the volumetric chamber 7*c* is gradually increased towards the outlet side. As shown in FIGS. 2 and 3, the cross sectional area of the volumetric chamber 7*c*, taken along a plane normal to the general flow direction, increases along the general flow direction of the exhaust gas, from the inlet side to the outlet side of the main body member of the manifold 1.

The volumetric chambers 7*a* and 7*b* are configured similarly to the volumetric chamber 7*c* with appropriate accomodation in the length and angular configuration. By such construction of the volumetric chambers 7*a*, 7*b* and 7*c*, the exhaust gas flowing into the branch tubes 3*a*, 3*b* and 3*c* is gradually expanded on flowing into the volumetric chambers 7*a*, 7*b* and 7*c* so as to be gradually decreased in flow velocity and gas pressure, after which the exhaust gas becomes confluent with the exhaust gas from the remaining branch tubes. There results a reduced interference noise between the exhaust gas flows exhausted from the different branch tubes.

As shown in FIG. 1 the inlet side of the volumetric chamber 7*c* is formed in a recessed, curved configuration so as to provide a gradually increasing effect of the cross-sectional area at the inlet part thereof.

As shown in FIG. 3, the profile of the upper and lower member 1*a*, 1*b* is defined so as to provide the gradual increase in the cross-sectional area of the volumetric chamber 7*c* taking in account of the narrowing width of the volumetric chamber towards the merging point of pair of tubes.

Figure 4A:
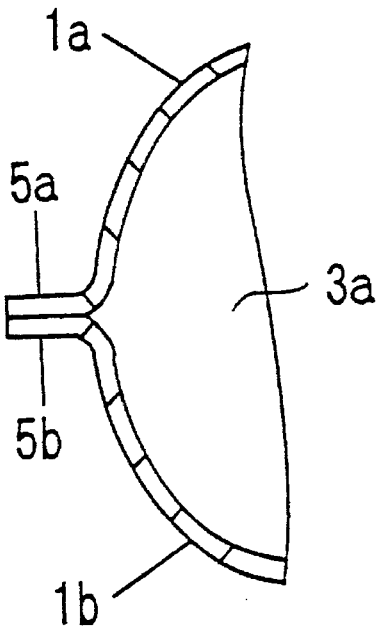
FIGS. 4A and 4B are enlarged sectional views respectively taken along lines 4A—4A of FIG. 1 and taken along line 4B—4B in FIG. 1 corresponding to the bend portion of the branch tube 3*a*.
Figure 4B:
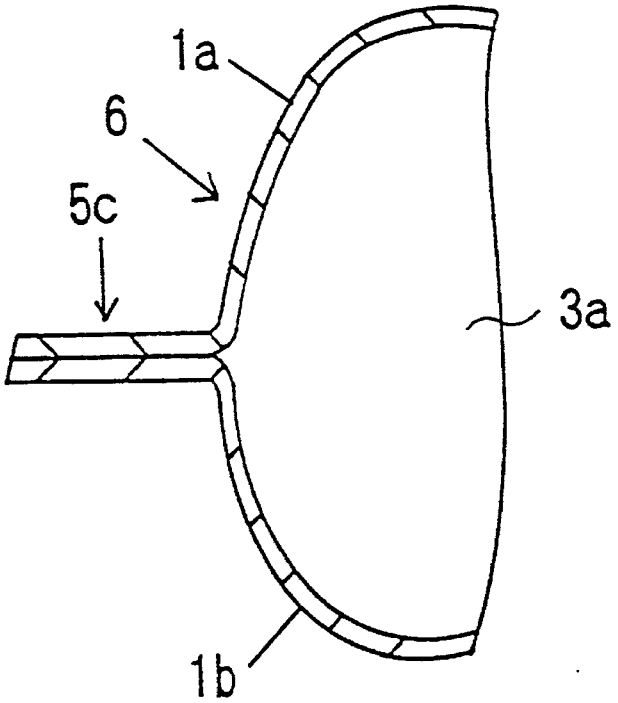

FIGS. 4A and 4B shows the cross-section of the joining flange portion 5*a* outside of the branch tube 3*a* in an enlarged scale. FIG. 4A is an enlarged cross-sectional view taken along line 4A—4A in FIG. 1, and FIG. 4B is an enlarged cross-sectional view taken along line 4B—4B for showing the bend 6 of the branch tube 3*a*.

Referring to FIG. 4A, the upper member and the lower member are welded together via the respective joining flange portions 5*a*, 5*b*, on a line 4A—4A at the inlet side of the main body member of the manifold 1, and delimits the branch tube 3*a*.

In the present embodiment, the joining flange portions 5*a*, 5*b* at various portions of the main body member of the manifold 1 are of substantially the same width except a width of the joining flange portion 5*c* at the bend 6 of the branch tube 3*a* as shown in FIG. 1.

Referring to FIG. 4B, the joining flange portion 5*c* between the upper member 1*a* and the lower member 1*c* at the bend 6 of the longest branch tube 3 among the respective branch tubes has a width larger than the width of the joining flange portions 5*a*, 5*b* shown in FIG. 4A. That is, the joining flange portion is of the largest width among the joining flange portions of the main body member of the manifold 1.

If the exhaust gas at a high temperature flows through the exhaust manifold, the exhaust manifold is expanded and contracted by heating and cooling caused by the inflow and outflow of the exhaust gas.

Above all, if the exhaust manifold is connected to the exhaust side of a multi-cylinder internal combustion engine, since the stroke and the exhaust gas exhaust timing differ from one cylinder to another, the exhaust gas flows intermittently into the branch tubes connected to the cylinders, so that the branch tubes 3 are heated and cooled repeatedly to undergo thermal shocks. In addition, since the inlet side of the exhaust manifold is connected to the engine operated at a high temperature, while its outlet side is connected to the exhaust tube at a lower temperature, thermal stress is applied to the exhaust manifold.

Thus the upper member 1*a* and the lower member 1*b* undergo repeated expansion and contraction along the exhaust gas flow direction as a result of the inflow and discharge of the exhaust gas in and out of the exhaust manifold and the operation and halt of the engine. Above all, the bend of the longest branch tube 3*a* undergoes compressive stress higher than that in the remaining portions of the exhaust manifold from the inlet and outlet of the exhaust manifold along the flowing direction of the exhaust gas.

The stress tends to separate the upper member and the lower member from each other, which stress may be absorbed by the joining flange portion 5*c* having the broader width.

That is, if the force tending to separate the upper member 1*a* and the lower member 1*b* of the exhaust manifold from each other is applied to the bend of the longest tube 3, the outer side (outer peripheral side of the exhaust manifold) is kept in intimate contact state even though the inner side of the joining flange portion 5*c* (shown towards the branch tube 3*a* in FIG. 4B) absorbs this force and is thereby slightly separated apart from each other in the vertical direction, so that tight sealing of the exhaust manifold is maintained. On the other hand, this force is absorbed by the joining flange portion 5*c* of the broader width for suppressing stress propagation to the remaining portions of the exhaust manifold. Such effect may be increased by forming the joining flange portion 5*c* with a broader width in the vicinity of the sharpest bend of the branch tube with the smallest radius of curvature, that is the bend 6, as shown in FIG. 1.

Also, since the joining flange portion 5*c* having the increased width in the vicinity of the bend 6 of the branch tube 3*a* has a correspondingly larger cooling area, the bend 6 is cooled more intensively than other portions of the exhaust manifold due to heat radiation from the joining flange portion 5*c*, so that the bend 6 may be improved in durability. On the other hand, the size of a sheet metal as a starting material may be saved by forming only portions of the joining flange portions 5*a* and 5*b* with larger width.

Meanwhile, since the upper and lower members 1*a*, 1*b* are produced by pressing (a type of plastic working) of a single metal sheet, these members may be fabricated with a low cost and high yield. In addition, the pressing renders it possible to reduce the thickness and weight of the product and to assure smooth finishing of the product surface.

The surfaces of the upper and lower members 1*a* and 1*b* assigned to the inner surfaces of the main body member of the manifold 1 are rust-proofed and coated with a heat-insulating coating. Since these members are separately processed for drawing into the shape of semi-tubes which are subsequently joined to each other, the surfaces may easily be processed prior to joining with inner surface processing as required.

For checking the effect of a preferred embodiment of the present invention, an exhaust manifold is mounted via a mounting flange 2*a* on the exhaust side (cylinder head) of a 4-cycle multi-cylinder engine and a test on exhaust pulsation was conducted for measuring pressure fluctuations at an exhaust manifold outlet versus the engine crank angle (engine stroke) using an exhaust manifold of the present embodiment and a conventional exhaust manifold as a Comparative Example.

Figure 5:
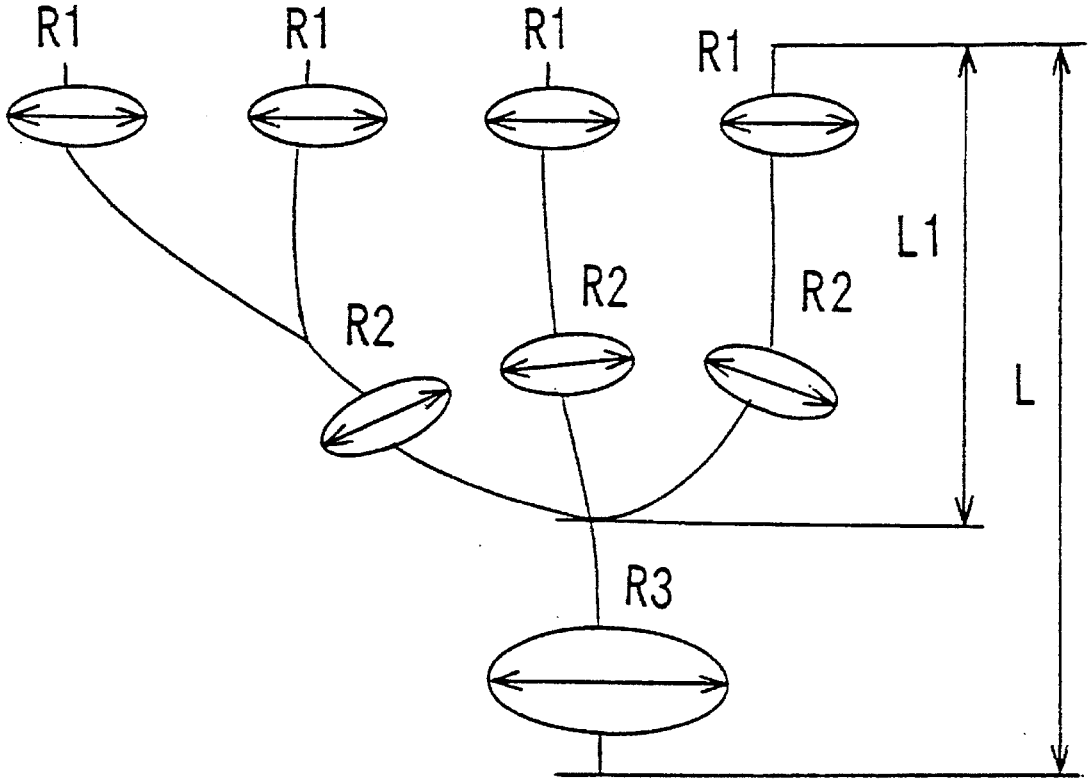
FIG. 5 schematically shows a line system of tubes of an exhaust manifold according to an embodiment of the present invention, as employed for tests on exhaust pulsation.
Figure 6:
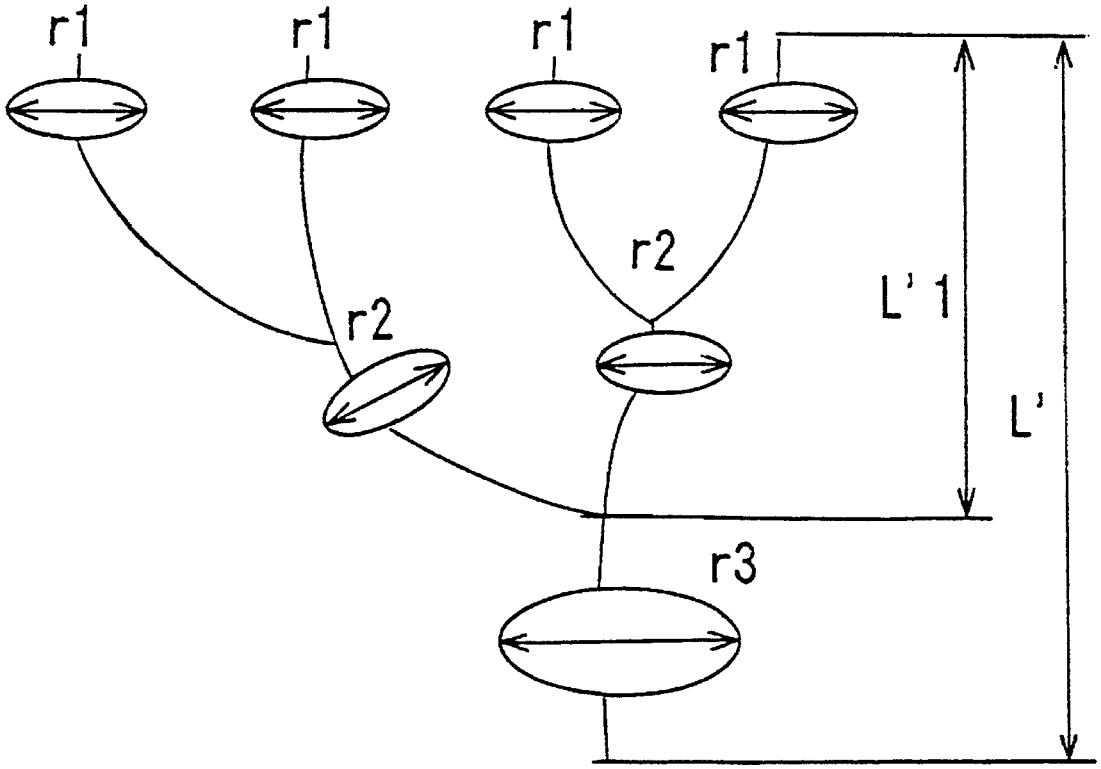
FIG. 6 schematically shows a line system of tubes of an exhaust manifold according to a Comparative Example as employed in the test.

FIG. 5 schematically shows a line system of an exhaust manifold according to an Example of the present invention employed for tests on exhaust pulsation and FIG. 6 schematically shows a line system of an exhaust manifold according to a Comparative Example as employed in the test.

The exhaust manifold of the preferred embodiment of the present invention, employed in the above experiment, has a construction as shown in FIGS. 1 and 5. The imaginary tube diameter is shown enlarged at the connection area of the branch tubes for convenience in the coupling between the branch tubes and between the branch tubes and the collecting tube, respectively.

Referring to FIG. 6, the exhaust manifold of the Comparative Example similarly has four branch tubes and one collecting tube, while not having the volumetric chamber as is provided in the Example of the present invention.

Referring to FIGS. 5 and 6, it is assumed that the tube diameters in the Example and the Comparative Example in the vicinity of the inlet to the branch tubes are R1 and r1, respectively; the imaginary tube diameters in the collecting portion of the two branch pipes (3*a* and 3*b* in the Example) are R2 and r2, respectively; and the tube diameters of the collecting tubes are R3 and r3, respectively. It is noted that R2 is equal to the imaginary diameter of the branch tube 3*c* or 3*d* prior to the connection of the branch tubes 3*c* and 3*d* to the collecting tube 4. Thus the dimensions were set as follows in mm: for R1=r1=ϕ29, R2=r2=ϕ37 and R3' r3=ϕ45.6, resulting in following ratios of radii: R2/R1=r2/1=1.3 and R3/R2=r3/r2=1.2. On the other hand, for the distances from the inlet to the branch tubes to the collecting portion of the branch tubes of L1 and L'1, and the distances from the inlets to the branch tubes to the output of the collecting tube are L and L', respectively, L1=L'1 and L=L', while the outer frame sizes of the Example and the Comparative Example are substantially equal to each other.

Figure 7:
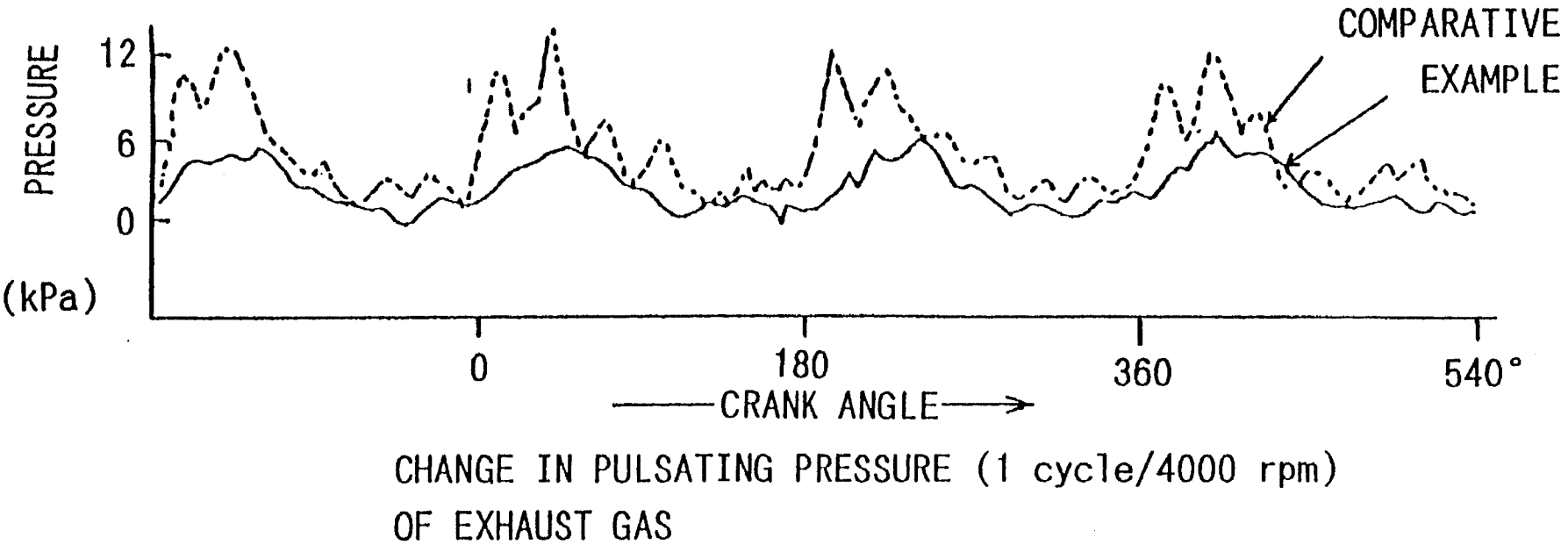
FIG. 7 is a graph showing changes in the exhaust gas pressure at an outlet of an exhaust manifold versus the crank angle during the exhaust stroke, wherein a solid line and a broken line indicate such change for the inventive Example and that for the Comparative Example, respectively.

FIG. 7 is a graph showing changes in the exhaust gas pressure at an outlet of an exhaust manifold versus to the crank angle during the exhaust stroke, wherein a solid line and a broken line indicate such changes for the Example and those for the Comparative Example, respectively.

It is seen from FIG. 7 that, by employing the exhaust manifold embodying the present invention, the exhaust gas pressure level is substantially halved, while the gas pressure fluctuations versus the crank angle are reduced to approximately one-third. Thus the noise (sound) of interference between the exhaust gases exiting the branch tubes is reduced significantly.

The joining flange portions of the upper and lower members are welded generally at the outer periphery of the flange portions may be conducted according to conventional methods, e.g., by welding the outer periphery of the flange portions (called welding-all-around) or fillet welding depending on the case. Seam welding may be employed, too.

Further variable embodiments of the present invention will now be explained.

In the above embodiment, the exhaust manifold 1 is formed by plastic processing (processing) a sheet metal. In an other embodiment, the volumetric chamber of the above embodiment may be provided at an exhaust manifold formed of casting.

In the above embodiment, volumetric chambers are provided between all the respective neighboring branch tubes. In a further embodiment, only one such volumetric chamber may be provided between merely two branch tubes.

In the above embodiment, the joining flange portion 5*c* of the acutest bend of the longest branch pipe has a broader width. In a still further embodiment, the joining flange portion 5*a* along a bend of the branch tube 3*b*, 3*c* or 3*d* may be of a broader width, so long as the bend is provided.

In the above embodiment, the cross-section of the volumetric chamber 7*c* lying at right angles to the general flow direction is substantially rectangular, whereas, in the other embodiments, it may be substantially circular, elliptical, polygon, or else.

In the above embodiment, the tubular shape of the branch tubes and the collecting tube is formed from a single sheet metal by pressing and sheeting. In other embodiments, the sheet metal may be plastic-worked using other plastic working methods, such as forging, rolling, extrusion or drawing, such as press forging or swaging.

In the above embodiment, the main body member of the manifold is fabricated by joining the upper and lower members at a plane containing the center axes of plural branch tubes, In other embodiments, the two members may be joined together along a cross-section lying at right angles to the above plane. Also the exhaust manifold may be assembled by joining 3 or more parts.

While the present invention has been explained with reference to the above preferred embodiment, it is not limited thereto and is intended to cover any modifications conforming to the principles of the invention within the scope as defined in the claims.

What is claimed is:

1. An exhaust manifold having an inlet side and an outlet side in which a plurality of branch tubes disposed at the inlet side are connected to a collecting tube disposed at the outlet side and in which fluid flows in a flowing direction from said branch tubes to said collecting tube, wherein a volumetric chamber is provided between at least a pair of said branch tubes and is in communication with said pair of branch tubes, said volumetric chamber having a cross-sectional area that generally increases as viewed in a plane normal to the flowing direction of said fluid.

2. The exhaust manifold as defined in claim 1 wherein said pair of branch tubes neighbor said at least one volumetric chamber.

3. The exhaust manifold as defined in claim 2 comprising an upper member and a lower member, said upper member and the lower member being connected to each other at a plane including a center axis of each of said pair of branch tubes.

4. The exhaust manifold as defined in claim 3 wherein said volumetric chamber is defined by said upper member and the lower member.

5. The exhaust manifold as defined in claim 4, wherein the volumetric chamber has one side, disposed on the inlet side, that is closed by flange portions of the upper and lower members being joined to one another.

6. The exhaust manifold as defined in claim 1, wherein a portion of the volumetric chamber positioned between the two branch portions on the inlet side is curved to provide a gradual increase of the cross-sectional area.

7. The exhaust manifold as defined in claim 4, wherein the pair of branch tubes merge towards one another to a merging point, the volumetric chamber narrowing in width towards the merging point of the pair of branch tubes.

8. The exhaust manifold as defined in claim 4 wherein said upper and lower members are each formed by plastic working of a single sheet metal.

9. The exhaust manifold as defined in claim 1 wherein said pair of branch tubes are neighboring branch tubes that neighbor said volumetric chamber, said inlet side of said exhaust manifold being connected to an exhaust side of an internal combustion engine having plural cylinders.

10. The exhaust manifold as defined in claim 4 wherein surfaces of the upper member and the lower member which form inner surfaces of a main member of the manifold are processed by inner surface treatment.

11. An exhaust manifold having an inlet side and an outlet side, said exhaust manifold comprising at least an upper member and a lower member, in which a plurality of branch tubes disposed at the inlet side are connected to a collecting tube disposed at the outlet side, at least one of the branch tubes having a bend, said upper member and the lower member being interconnected along a joining flange which extends along a straight portion of the at least one branch tube and along the bend, the width of the portion of the joining flange extending along the straight portion of the at least one branch tube being substantially constant, a portion of the joining flange extending along the bend having a broader width than remaining portions of the joining flange.

12. The exhaust manifold as defined in claim 11 wherein said at least one of the branch tubes is a longest one of the branch tubes.

13. The exhaust manifold as defined in claim 12 wherein said upper and lower members are joined to each other at a plane including a center axis of each of said branch tubes.

14. The exhaust manifold as defined in claim 11 wherein said upper member and the lower member are formed by plastic working, said pair of branch tubes being branch tubes that neighbor said volumetric chamber, a mounting flange is connected to the inlet side of the exhaust manifold, and said mounting flange is mounted on a cylinder head of an internal combustion engine.

* * * * *